United States Patent [19]

Shpigel et al.

[11] Patent Number: 4,819,904

[45] Date of Patent: Apr. 11, 1989

[54] SUPPORT MEMBER

[76] Inventors: Leonid Shpigel, 9 Horak Avenue, Camps Bay 8001; Jeffrey C. Berzack, "Dobs Den" Peter Cloete Avenue, Constantia 7800, both of South Africa

[21] Appl. No.: 113,164

[22] Filed: Oct. 27, 1987

[51] Int. Cl.[4] ..... F16M 13/00

[52] U.S. Cl. ..... 248/545; 248/156; 248/530

[58] Field of Search ..... 248/530, 533, 545, 156; 52/157, 155, 165, 298, 726, 105, 103

[56] References Cited

U.S. PATENT DOCUMENTS

| | | | |
|---|---|---|---|
| 1,791,368 | 2/1931 | Mullett | 52/157 |
| 2,084,239 | 6/1937 | Bradford | 52/157 X |
| 2,103,948 | 12/1937 | Jones | 248/156 X |
| 2,209,504 | 7/1940 | Beiter | 248/530 |
| 2,211,283 | 8/1940 | Mercer | 248/156 |
| 2,441,109 | 5/1948 | Carlson | 248/156 V X |
| 2,575,572 | 11/1951 | Wickstrum | 248/156 V X |
| 2,643,843 | 6/1953 | Brown | 248/156 |
| 3,378,967 | 4/1968 | Baumeister | 52/157 X |
| 4,249,715 | 2/1981 | Repp | 248/156 X |
| 4,520,985 | 6/1985 | Blumenthal | 248/156 X |

FOREIGN PATENT DOCUMENTS

| | | | |
|---|---|---|---|
| 706081 | 3/1965 | Canada | 52/157 |

*Primary Examiner*—J. Franklin Foss

*Attorney, Agent, or Firm*—Larson & Taylor

[57] ABSTRACT

A support device for fitting to the end of a tubular member, such as an umbrella pole. It includes a cone-shaped body having a base and a pointed tip. An external screw-thread extends spirally on the cone-shaped body. A cylindrical connection member extends from the base of the cone-shapoed body and is adapted to be fitted into an open end of a tubular member. Two substantially flat surfaces extend from the base to the tip and define an acute angle between them and interrupt the screw-thread formation into interrupted thread sections. At least one connection recess is provided in the cylindrical member for receiving an associated projecting part extending from a tubular member, such as a lower end of an umbrella pole, for locking engagement therewith.

7 Claims, 3 Drawing Sheets

SUPPORT MEMBER

FIELD OF INVENTION

The present invention relates to support devices.

More particularly, the invention relates to support devices for tubular members, such as poles or the like, eg. umbrella poles, the support devices having a threaded body.

BACKGROUND TO INVENTION

Various support devices with threaded bodies for tubular members, such as poles, in particular poles for umbrellas, have been suggested. These devices often are complicated to manufacture and difficult to fit to the end of such poles.

It is an object of the invention to suggest a support device for a pole which is relatively simple to manufacture and easy to fit to the bottom end of a pole.

SUMMARY OF INVENTION

According to the invention, there is provided a support device for fitting to the end of a tubular member, such as an umbrella pole, which device includes a cone-shaped body having a base at its broad end and a pointed tip at its narrow end; an external screw-thread extending spirally before the word extending several times around the cone-shaped body between the base and the pointed tip; a cylindrical connection member extending from the base of the cone-shaped body in a direction opposite to the tip and being adapted to be fitted into an open end of a tubular member; two substantially flat continuous surfaces extending from the base to the tip on opposite sides of the cone-shaped body so as to define an acute angle between them and interrupting the screw-thread formation into interrupted thread sections; and at least one connection recess in the cylindrical member for receiving an associated projecting part extending from a tubular member, such as a lower end of an umbrella pole, for locking engagement therewith.

The cylindrical member may be tapered slightly away from the base.

The cylindrical member may be in the form of a tube.

Two connection recesses may be provided on either side of the cylindrical member and being spaced apart.

The device may be injection moulded from suitable synthetic plastics material.

The base may be in the form of a collar.

The collar may have a diameter which does not exceed the diameter of a tubular member to which it is adapted to be fitted.

BRIEF DESCRIPTION OF DRAWINGS

The invention will now be described by way of example with reference to the accompanying schematic drawings.

In the drawings there is shown in

DETAILED DESCRIPTION OF DRAWINGS

Figure 1:
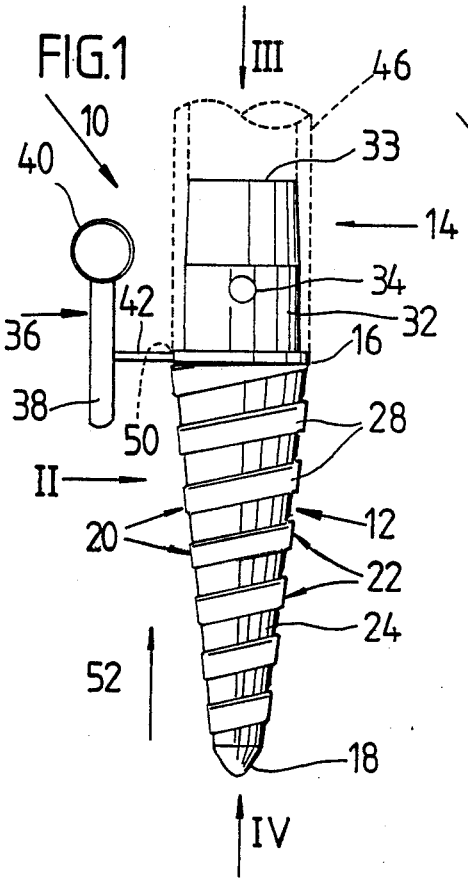
FIG. 1 a side view of a first embodiment of a support device for a pole, such as an umbrella pole, in accordance with the invention.

Referring to the drawings, the support device 10 in accordance with the invention is adapted to be fitted to the bottom open end of a pole, such as an umbrella pole. (If the pole is pointed or closed, it has to be cut off to provide an open end for fitting the device 10). The device 10 includes a cone-shaped body 12 and a connection formation in the form of a cylindrical connection member 14.

The body 12 has a base collar 16 and a pointed tip 18. Between the base collar 16 and the pointed tip 18 two opposite substantially flat surfaces 20 and 22 extend, and converge towards each other defining an acute angle (of about 15° to 30°) between them. Between these flat surfaces 20, 22 and on the remaining surfaces 24, 26 of the body 12 a helical screw-thread formation is formed on the body 12. This screw thread formation is interrupted by the flat surfaces 20, 22 so that screw thread sections 28 result on the surface 24 of the body 12 and screw thread sections 30 on the opposite surface 26 of the body 12.

The cylindrical member 14 includes a tapered cylinder 32 with an open upper end 33. The cylinder 32 has two opposite connection recesses 34.

A hammering cup member 36 having an arm 38 and a cup 40 is injection moulded together with the device 10 and is joined thereto by way of the joining arm 42. These parts constitute the fitting tools for fitting the device to a pole.

The device 10 as shown in FIGS. 1 to 4 is injection moulded from suitable synthetic plastics material, such as polypropylene. It is injection moulded in one part as shown.

Figure 3:
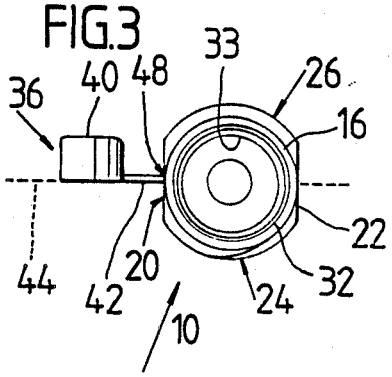
FIG. 3 a view from above seen along arrow III in FIG. 1.
Figure 4:
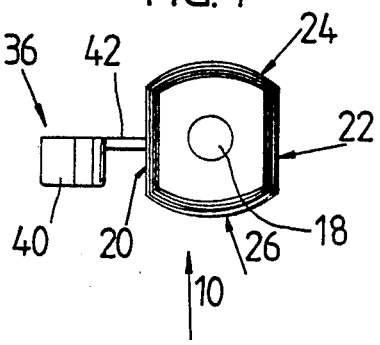
FIG. 4 a view from below seen along arrow IV in FIG. 1.

Due to the flat surfaces 20 and 22 the mould for injection moulding the device 10 can move in opposite directions away from the parting line 44 shown in FIG. 3. The opening movement of the mould would be at an angle to the longitudinal axis of the body 12 in accordance with the angle of the screw thread formation sections. Thereby the device can be produced in a mould by way of a shorter cycle time than would be in the case with a mould opening in more complicated fashion.

The purpose of the device 10 is to enable a pole, to which it is fitted, to be turned into soil or sand easily.

Figure 5:
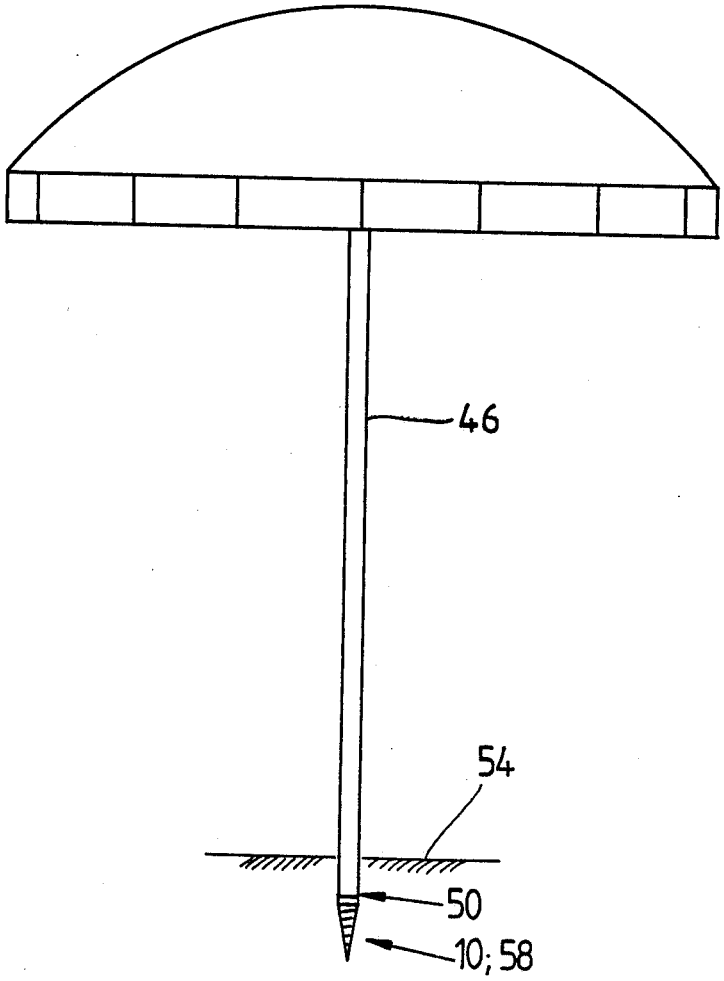
FIG. 5 on a reduced scale, a side view of an umbrella pole to which a support device in accordance with the invention is fitted.

For attaching the device 10 to the open bottom end of a pole, such as an umbrella pole 46 (see FIG. 5), the member 36 is detached from the base 16 by tearing it off at the position indicated by reference numeral 48 (see FIG. 5). Thereafter the tapered end 33 is pressed into the open bottom end 50 of the pole 46. The arm 38 is held so that the cup 40 is in contact with the tip 18. The cup 38 then is hammered in the direction indicated by reference numeral 52 so as to force the upper end 33 and thus the cylinder 32 into the open end 50 of the pole 46 until the base collar 16 abuts against the bottom end of the pole 46. (The bottom end 50 of the pole 46 is shown in dotted lines in FIG. 1). Thereby the cylinder 32 is frictionally fitted to the pole 46.

When fully knocked in, the cup 40 is used to measure from the collar 16 upwardly on the outside of the pole 46 to indicate the position of the recess 34 from the base collar 16. Then, by means of a pin, the pole 46 is hammered at this position so as to force the metal of the pole 46 into the recess 34 so as to connect the two parts (ie. the cylinder 32 and the pole 46) tightly together and to prevent rotation of the device 10 relative to the pole 46. This connection is in addition to the frictional fit.

The pole 46 then can be turned into soil 54 or another supporting surface as may be required.

Figure 2:
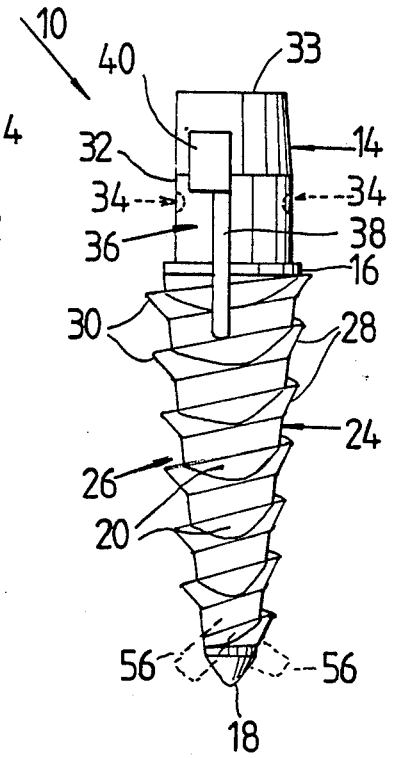
FIG. 2 a side view seen along arrow II in FIG. 1.

Metal cutting members, as indicated in dotted lines 56 in FIG. 2, may be embedded at the tip 18 of the body 12, to facilitate penetration of the body 12 into harder types of soil or the like.

Figure 6:
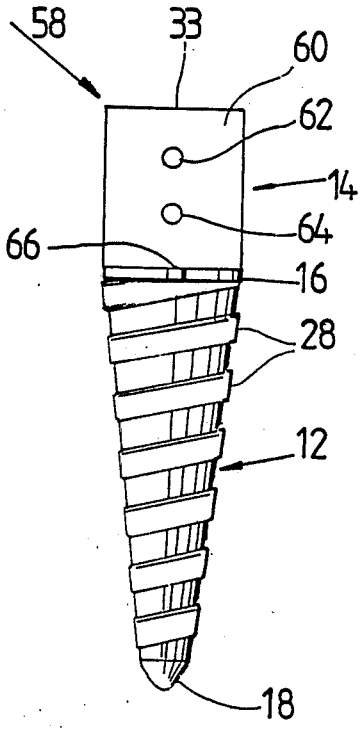
FIG. 6 a side view of a second embodiment of a support device for a pole in accordance with the invention.
Figure 7:
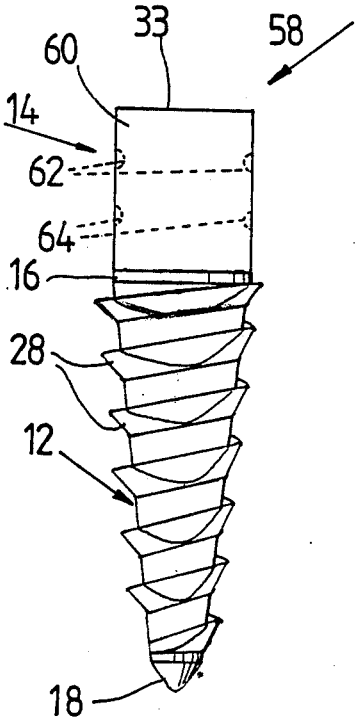
FIG. 7 a side view seen along arrow VII in FIG. 6.

Referring now to FIGS. 6 and 7 the same reference numerals will be used to describe identical parts.

Here the pole support device 58 also has a cone-shaped body 12 with screw thread sections 28, 30, etc. but the cylindrical member 14 has a cylinder 60, which is not tapered but is cylindrical with uniform cross-section. Furthermore two spaced apart connection recesses 62, 64 (equivalent to the recess 34 of FIGS. 1 to 4) are provided on opposite sides of the cylinder 60.

The fitting tools (ie. the cup 40 and arm 38 of FIGS. 1 to 4) are manufactured and provided separately.

The collar 16 has a marking line 66 to indicate the position of the recesses 62, 64. (This marking line 66 may also be provided on the device illustrated in FIGS. 1 to 4).

The fitting of the device 58 to an umbrella pole 46 is similar to the procedure as described with reference to FIGS. 1 to 4.

It is important to note that the external diameter of the device 10 (FIGS. 1 to 4) or the device 58 (FIGS. 6 and 7), in particular at the collar 16, does not exceed the external diameter of the pole 46 to which it is to be fitted. This means that the pole 46 can be inserted through any conventional holes (eg. in garden tables or other garden furniture) and the device 10 or 58 would not prevent such passing through.

We claim:

1. A support device for fitting to the end of a tubular member, which device includes a cone-shaped body having a base at its broad end and a pointed tip at its narrow end; an external screw-thread formation having a screw thread extending spirally several times around the cone-shaped body between the base and the pointed tip; a cylindrical connection member extending from the base of the cone-shaped body in a direction opposite to the tip and being adapted to be fitted into an open end of a tubular member; two substantially flat continuous surfaces extending from the base to the tip on opposite sides of the cone-shaped body so as to define an acute angle between them and interrupting the screw-thread formation into interrupted thread sections; and at least one connection recess in the cylindrical member for receiving an associated projecting part extending from a tubular member, for locking engagement therewith.

2. A device as claimed in claim 1, in which the cylindrical member is tapered slightly away from the base.

3. A device as claimed in claim 1, in which the cylindrical member is of tubular form.

4. A device as claimed in claim 1, in which two connection recesses are provided on either side of the cylindrical member and being spaced apart.

5. A device as claimed in claim 1, which is injection moulded from suitable synthetic plastics material.

6. A device as claimed in claim 1, in which the base is in the form of a collar.

7. A device as claimed in claim 6, in which the collar has a diameter which does not exceed the diameter of a tubular member to which it is adapted to be fitted.

* * * * *